US010005291B2

(12) United States Patent
Yamazaki

(10) Patent No.: US 10,005,291 B2
(45) Date of Patent: Jun. 26, 2018

(54) THERMAL TRANSFER PRINTER AND METHOD FOR CONTROLLING THE SAME

(71) Applicants: CITIZEN WATCH CO., LTD., Tokyo (JP); CITIZEN SYSTEMS JAPAN CO., LTD., Tokyo (JP)

(72) Inventor: Takeshi Yamazaki, Nagano (JP)

(73) Assignees: CITIZEN WATCH CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 0 days. days.

(21) Appl. No.: 15/316,530

(22) PCT Filed: Dec. 25, 2015

(86) PCT No.: PCT/JP2015/086382
§ 371 (c)(1),
(2) Date: Dec. 6, 2016

(87) PCT Pub. No.: WO2016/151971
PCT Pub. Date: Sep. 29, 2016

(65) Prior Publication Data

US 2017/0210143 A1 Jul. 27, 2017

(30) Foreign Application Priority Data

Mar. 26, 2015 (JP) ..... 2015-065093

(51) Int. Cl.
*B41J 2/525* (2006.01)
*B41J 29/38* (2006.01)

(52) U.S. Cl.
CPC ..... *B41J 2/525* (2013.01); *B41J 29/38* (2013.01)

(58) Field of Classification Search
CPC ... B41J 2/525; B41J 35/16; B41J 35/18; B41J 2002/0052; B41J 2/315; B41J 2/32;
(Continued)

(56) References Cited

U.S. PATENT DOCUMENTS

2001/0055420 A1 12/2001 Nagatani
2005/0024420 A1 2/2005 Ebihara
(Continued)

FOREIGN PATENT DOCUMENTS

JP H06-293145 A 10/1994
JP H06-297737 A 10/1994
(Continued)

OTHER PUBLICATIONS

International Search Report for PCT/JP2015/086382, dated Mar. 15, 2016.
(Continued)

*Primary Examiner* — Kristal Feggins

(57) ABSTRACT

When sub-images are sequentially transferred and connected together to form a larger image than would be possible with a single transfer operation, the occurrence of a color change in the overlapping region of the sub-images is suppressed and the width of the overlapping region is reduced as much as possible. Color image data are divided into image data of two sub-images containing an overlapping region and having edges that coincide for each color ink transferred to paper. Color values of the color image data in the overlapping region are converted by using a color conversion factor group created in advance for each position on the overlapping region so as to cancel out a color change that occurs in the overlapping region when the sub-images are transferred with one overlapping the other. The image data of the sub-images are corrected by adjusting converted color values in the overlapping region by using a correction factor for print density at each position on the overlapping region. A color image is formed by sequentially transferring the sub-images in accordance with corrected image data thereof so that the sub-images overlap at the overlapping region.

4 Claims, 13 Drawing Sheets

(58) Field of Classification Search
CPC ..... B41J 2/33; B41J 2/325; B41J 2/385; B41J 2/435; B41J 2/4075; B41F 16/00; B41F 16/0006
See application file for complete search history.

(56) References Cited

U.S. PATENT DOCUMENTS

| | | | | |
|---|---|---|---|---|
| 2005/0174374 | A1 | 8/2005 | Ebihara et al. | |
| 2007/0132798 | A1 | 6/2007 | Bansyo | |
| 2010/0091080 | A1 | 4/2010 | Yaguchi | |
| 2010/0118318 | A1 | 5/2010 | Fuse et al. | |
| 2010/0182367 | A1 | 7/2010 | Takagi et al. | |
| 2010/0238223 | A1* | 9/2010 | Yamazaki | B41J 2/2146 347/14 |
| 2012/0050360 | A1* | 3/2012 | Nagamura | B41J 2/2114 347/7 |
| 2012/0229549 | A1* | 9/2012 | Shibata | B41J 2/04508 347/15 |
| 2013/0016172 | A1 | 1/2013 | Furuki et al. | |

FOREIGN PATENT DOCUMENTS

| | | | |
|---|---|---|---|
| JP | H07-108691 | A | 4/1995 |
| JP | H10-058732 | A | 3/1998 |
| JP | 2002-001939 | A | 1/2002 |
| JP | 2003-246092 | A | 9/2003 |
| JP | 2003-285434 | A | 10/2003 |
| JP | 2004-082610 | A | 3/2004 |
| JP | 2006-231735 | A | 9/2006 |
| JP | 2006-270771 | A | 10/2006 |
| JP | 2007-160682 | A | 6/2007 |
| JP | 2009-160852 | A | 7/2009 |
| JP | 2010-137553 | A | 6/2010 |
| JP | 2011-088305 | A | 5/2011 |
| JP | 2011-116096 | A | 6/2011 |
| JP | 2012-030521 | A | 2/2012 |
| JP | 2012-076402 | A | 4/2012 |
| JP | 5349684 | B2 | 8/2013 |

OTHER PUBLICATIONS

Written Opinion of the International Searching Authority for PCT/JP2015/086382, dated Mar. 15, 2016.

* cited by examiner

FIG. 4

(A)

| | | X | | | | |
|---|---|---|---|---|---|---|
| | | $L_1$ | $L_2$ | ··· | $L_{n-1}$ | $L_n$ |
| Y | 0 | 0 | 0 | ··· | 0 | 0 |
| | : | : | : | : | : | : |
| | 64 | 1 | 0.90 | ··· | 0.18 | 0.10 |
| | : | : | : | : | : | : |
| | 128 | 1 | 0.93 | ··· | 0.22 | 0.13 |
| | : | : | : | : | : | : |
| | 255 | 1 | 0.97 | ··· | 0.25 | 0.15 |

(B)

| | | X | | | | |
|---|---|---|---|---|---|---|
| | | $L_1$ | $L_2$ | ··· | $L_{n-1}$ | $L_n$ |
| Y | 0 | 1 | 1 | ··· | 1 | 1 |
| | : | : | : | : | : | : |
| | 64 | 0.10 | 0.18 | ··· | 0.99 | 1 |
| | : | : | : | : | : | : |
| | 128 | 0.05 | 0.14 | ··· | 0.99 | 1 |
| | : | : | : | : | : | : |
| | 255 | 0.02 | 0.06 | ··· | 0.99 | 1 |

THERMAL TRANSFER PRINTER AND METHOD FOR CONTROLLING THE SAME

TECHNICAL FIELD

The present invention relates to a thermal transfer printer and a method for controlling the same.

BACKGROUND ART

FIG. 12 is a diagram for explaining a normal printing operation performed by a thermal transfer printer. A thermal transfer printer capable of color image printing uses, for example, an ink ribbon 4 on which color ink regions of yellow Y, magenta M, and cyan C and an overcoat OP region are arranged in the same order in a repeated manner along its longitudinal direction, and prints (forms) an image I on a rolled paper 10 by sequentially transferring the inks of different colors, etc., onto the paper 10, while transporting the ink ribbon 4 in the direction of arrow A1. In the normal printing operation, after sequentially transferring the yellow Y, magenta M, and cyan C inks and the overcoat OP onto the paper 10, the thermal transfer printer transports the paper 10 in the direction of arrow A2 and cuts its leading edge; then, the printer further transports the paper 10 in the direction of arrow A2 and cuts the trailing edge of the image I, thus discharging the printed page out of the printer.

In such printers, the printable image size is limited by the size of each color ink region of the ink ribbon 4, but a printing technique is known in the art which achieves a print of a size larger than the size of each color ink region of the ink ribbon 4 by first printing one image and then the next image in succession without cutting the paper 10. Such printing is hereinafter referred to as "panoramic printing".

FIGS. 13(A) to 13(D) are diagrams for explaining a prior art panoramic printing method. If a plurality of images are simply printed in succession without cutting the paper 10, a blank space $I_3$ will remain between the first image $I_1$ and the second image $I_2$ on the paper 10, as shown in FIG. 13(A). If, in order to eliminate this blank space $I_3$, the first image $I_1$ and the second image $I_2$ are printed by partially overlapping their edges, as shown in FIG. 13(B), the print density of the image overlapping region $I_o$ will become higher than the print density of the other regions, thus showing the overlapping region $I_o$ visibly. In FIGS. 13(B) and 13(C), x represents the position along the longitudinal direction of the paper 10 (the direction of arrow A2 in FIG. 12), and f(x) represents the print density at position x.

In view of the above, there is proposed, for example, in patent documents 1 and 2, a method for adjusting the print density in the overlapping region $I_o$ of the two images by gradually decreasing the print density of the first image $I_1$ toward its trailing edge (the edge nearer to the second image) and gradually increasing the print density of the second image $I_2$ from its leading edge (the edge nearer to the first image), as shown in FIG. 13(C). On the other hand, in patent document 3, there is proposed a method for making the image connecting edges less visible by offsetting the connecting edges of the two images $I_1$ and $I_2$ in the sub-scanning transfer direction for each of the Y, M, and C colors and correcting the grayscale data of the overlapping region based on a predetermined correction factor for each line extending in the sub-scanning transfer direction.

PRIOR ART DOCUMENTS

Patent Documents

Patent document 1: Japanese Unexamined Patent Publication No. H06-297737

Patent document 2: Japanese Unexamined Patent Publication No. 2004-082610

Patent document 3: Japanese Patent No. 5349684

SUMMARY OF THE INVENTION

However, when printing two images by overlapping one onto the other, there can occur a back transfer phenomenon in which the previously transferred ink is transferred back onto the ink ribbon due to the applied energy during the subsequent transfer operation and the transfer density thus drops, and an excessive transfer phenomenon in which the ink receiving layer on the paper changes in quality due to the previous transfer operation and thereby the density of the ink color subsequently transferred increases. Therefore, if the print density of the trailing edge portion of the first image is simply decreased gradually and the print density of the leading edge portion of the second image simply increased gradually in the overlapping region of the two images, the color developed in the overlapping region often may not match the color developed in the other regions, thus making it difficult to render the intended color in the overlapping region. On the other hand, if the connecting edges of the two images are offset for each of the Y, M, and C colors, the width of the region where the print density is adjusted between the adjacent images will become wider in the sub-scanning direction than would otherwise be the case, resulting in the disadvantage that the color ink regions of the ink ribbon cannot be utilized efficiently.

Accordingly, it is an object of the present invention to provide a thermal transfer printer and a method for controlling the same wherein when a plurality of sub-images are sequentially transferred and connected together to form a larger image than would be possible with a single transfer operation, the occurrence of a color change in the overlapping region of the sub-images is suppressed and the width of the overlapping region is reduced as much as possible.

Provided is a method for controlling a thermal transfer printer, including the steps of dividing color image data to be printed into image data of two sub-images containing an overlapping region and having edges that coincide for each of a plurality of color inks transferred to paper, converting color values of the color image data in the overlapping region by using a color conversion factor group created in advance for a plurality of different positions on the overlapping region so as to cancel out a color change that occurs in the overlapping region when the two sub-images are transferred with one overlapping the other, correcting the image data of the two sub-images by adjusting converted color values in the overlapping region by using a correction factor for print density at each position on the overlapping region, and forming a color image to be printed by sequentially transferring the two sub-images in accordance with corrected image data of the two sub-images so that the two sub-images overlap at the overlapping region.

Preferably, in the above converting step, the overlapping region is divided into a plurality of sub-regions along a main scanning direction of image transfer, and the color values of the color image data are converted for each of the plurality of sub-regions by using a color conversion factor group common within the sub-region.

Preferably, in the above converting step, the color values of the color image data are converted in two ways for each of the plurality of sub-regions by using a color conversion factor group created for the sub-region and a color conversion factor group created for a sub-region adjacent thereto, and the method further includes the step of acquiring the converted color values for the entire overlapping region by compositing the color values converted in two ways for each of the plurality of sub-regions.

Further, provided is a thermal transfer printer including an image dividing unit which divides color image data to be printed into image data of two sub-images containing an overlapping region and having edges that coincide for each of a plurality of color inks transferred to paper, a color converting unit which converts color values of the color image data in the overlapping region by using a color conversion factor group created in advance for a plurality of different positions on the overlapping region so as to cancel out a color change that occurs in the overlapping region when the two sub-images are transferred with one overlapping the other, a density correcting unit which corrects the image data of the two sub-images by adjusting converted color values in the overlapping region by using a correction factor for print density at each position on the overlapping region, and an image printing unit which forms a color image to be printed by sequentially transferring the two sub-images in accordance with corrected image data of the two sub-images so that the two sub-images overlap at the overlapping region.

According to the above thermal transfer printer and method for controlling the same, when a plurality of sub-images are sequentially transferred and connected together to form a larger image than would be possible with a single transfer operation, the occurrence of a color change in the overlapping region of the sub-images can be suppressed and the width of the overlapping region can be reduced as much as possible.

BRIEF DESCRIPTION OF THE DRAWINGS

FIG. 4 is a diagram showing examples of the density correction tables;

DESCRIPTION OF EMBODIMENTS

Hereinafter, with reference to the accompanying drawings, a thermal transfer printer and a method for controlling the same will be explained in detail. However, it should be noted that the present invention is not limited to the drawings or the embodiments described below.

Figure 1:
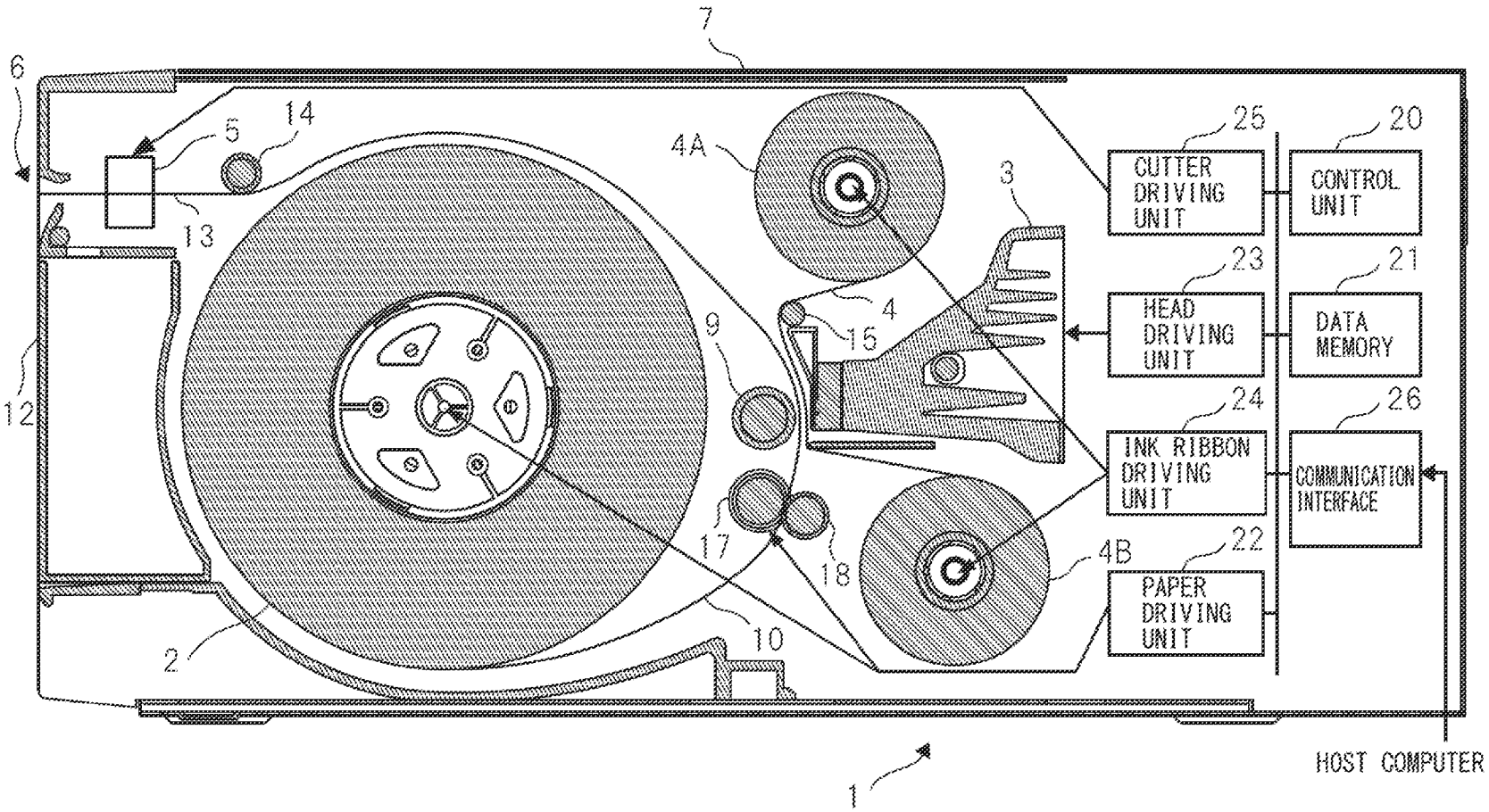
FIG. 1 is a cross-sectional view schematically illustrating the configuration of a printer 1.

FIG. 1 is a cross-sectional view schematically illustrating the configuration of a printer 1. In FIG. 1, of the various component elements of the printer 1, only those indispensable for explanation are shown, and the other component elements are omitted from the illustration.

The major component elements of the printer 1 include a rolled paper holder 2, a head (thermal head) 3, a ribbon supply roller 4A, a ribbon take-up roller 4B, a cutting unit 5, a platen roller 9, an discharge roller 14, a ribbon guide roller 15, a grip roller 17, and a pinch roller 18. These component elements are arranged in a cabinet 7.

The printer 1 is a thermal transfer printer which prints an image by transferring inks carried on an ink ribbon 4 onto rolled paper 10. The printer 1 sequentially transfers a plurality of color inks, for example, yellow, magenta, and cyan, and an overcoat from the ink ribbon 4 onto the same area on the paper 10 by moving the paper 10 back and forth relative to the head 3. The printed paper 10 is cut by the cutting unit 5 and discharged out of the printer 1 through an exit port 6 provided in the front face 12 of the printer 1. Printing an image may hereinafter be referred to as "forming an image".

The rolled paper holder 2 holds thereon the paper 10 wound into a roll. The material of the paper 10 is not specifically limited, the only requirement being that the paper be usable on the thermal transfer printer. The rolled paper holder 2 rotates around its center axis by being driven in the forward or backward direction. When the rolled paper holder 2 is driven to rotate in the forward direction, the paper 10 is transported toward the exit port 6 by passing between the head 3 and the platen roller 9. When the rolled paper holder 2 is driven to rotate in the backward direction, the paper 10 is rewound onto the rolled paper holder 2.

The ribbon supply roller 4A and the ribbon take-up roller 4B each hold the ink ribbon 4 thereon. These rollers are driven to rotate around their center axes by an ink ribbon driving unit 24 to be described later. By thus driving the rollers, the ink ribbon 4 is unwound from the ribbon supply roller 4A, is transported via the ribbon guide roller 15 and passed between the head 3 and the platen roller 9, and is wound on the ribbon take-up roller 4B.

The ink ribbon 4 is a belt-like sheet on which color ink regions of yellow, magenta, and cyan and an overcoat region, for example, are arranged in the same order in a repeated manner along its longitudinal direction. The ink ribbon 4 is available in various sizes, the size of each ink region being, for example, 6×4 inches or 6×8 inches, and the ink ribbon 4 that matches the image size to be printed is installed in the printer 1.

The head 3 is mounted so as to be movable relative to the platen roller 9, and during printing, the head 3 is pressed against the platen roller 9 with the ink ribbon 4 and the paper 10 sandwiched there between. The head 3 contains a plurality of heating elements, and forms an image on the paper by heating the heating elements and sequentially transferring the color inks and the overcoat from the ink ribbon 4 onto the same area on the paper 10. The transfer operation is repeated for each region of the ink ribbon 4, while the ink ribbon 4 is being wound. For the head 3, a mechanism is used that matches the type of the thermal transfer printer such as a sublimation printer or a thermal fusion printer.

The grip roller 17 and the pinch roller 18 transport the paper 10 by sandwiching it there between. The grip roller 17 is driven to rotate either in the direction in which the paper 10 is fed out (the forward direction) or in the direction in which it is rewound (the backward direction). The pinch roller 18 rotates by being driven by the grip roller 17. When transporting the paper 10, the pinch roller 18 is pressed against the grip roller 17 to hold the paper 10 between it and the grip roller 17, and when not transporting the paper 10, the pinch roller 18 is separated from the grip roller 17 to release the paper 10.

The paper 10 unwound from the rolled paper holder 2 and passed between the head 3 and the platen roller 9 is fed along an exit path 13 and transported by the discharge roller 14 toward the exit port 6. The cutting unit 5 is located in the exit path 13 at a position just before the exit port 6, and the paper 10 whose leading edge has passed the exit path 13 and fed out of the printer 1 is cut at the position just before the exit port 6.

The printer 1 further includes, in addition to the ink ribbon driving unit 24, a control unit 20, a data memory 21, a paper driving unit 22, a head driving unit 23, a cutter driving unit 25, and a communication interface 26.

The control unit 20 is constructed from a microcomputer including a CPU and a memory, and controls the entire operation of the printer 1. The data memory 21 is a storage area for storing image data received from a host computer via the communication interface 26. The paper driving unit 22 is a motor for driving the grip roller 17 and the rolled paper holder 2, and drives them to rotate either in the direction in which the paper 10 is fed out or in the direction in which it is rewound. The head driving unit 23 drives the head 3 based on the image data to print an image on the paper 10.

The ink ribbon driving unit 24 is a motor for driving the ribbon supply roller 4A and the ribbon take-up roller 4B, and drives them to rotate either in the direction in which the ink ribbon 4 is wound on the ribbon take-up roller 4B or in the direction in which the ink ribbon 4 is rewound onto the ribbon supply roller 4A. The cutter driving unit 25 is a motor for driving the cutting unit 5. The communication interface 26, for example, receives a print instruction and print image data from the host computer via a communication cable.

The printer 1 prints a panoramic image of a size (for example, 6×16 inches) larger than the size of each color ink region (for example, 6×8 inches) of the ink ribbon 4 by successively printing images, each equal in size to each color ink region, without cutting the paper 10 during the process. When successively transferring two images, since the printed color in the trailing edge portion of the first image can differ from the printed color in the leading edge portion of the second image due, for example, to a difference in the accumulated heat of the thermal head, an overlapping region about 10 to 20 mm in width, for example, is provided in order to accommodate such differences. In the overlapping region, after the Y, M, and C color inks have been transferred once, the Y, M, and C color inks are transferred once again; as a result, the printed color may become different from the YMC color corresponding to the RGB color of the original image data due to the back transfer phenomenon and the excessive transfer phenomenon. Therefore, the printer 1 suppresses the occurrence of color changes in panoramic printing by image processing in the host computer correcting for such color differences.

Figure 2:
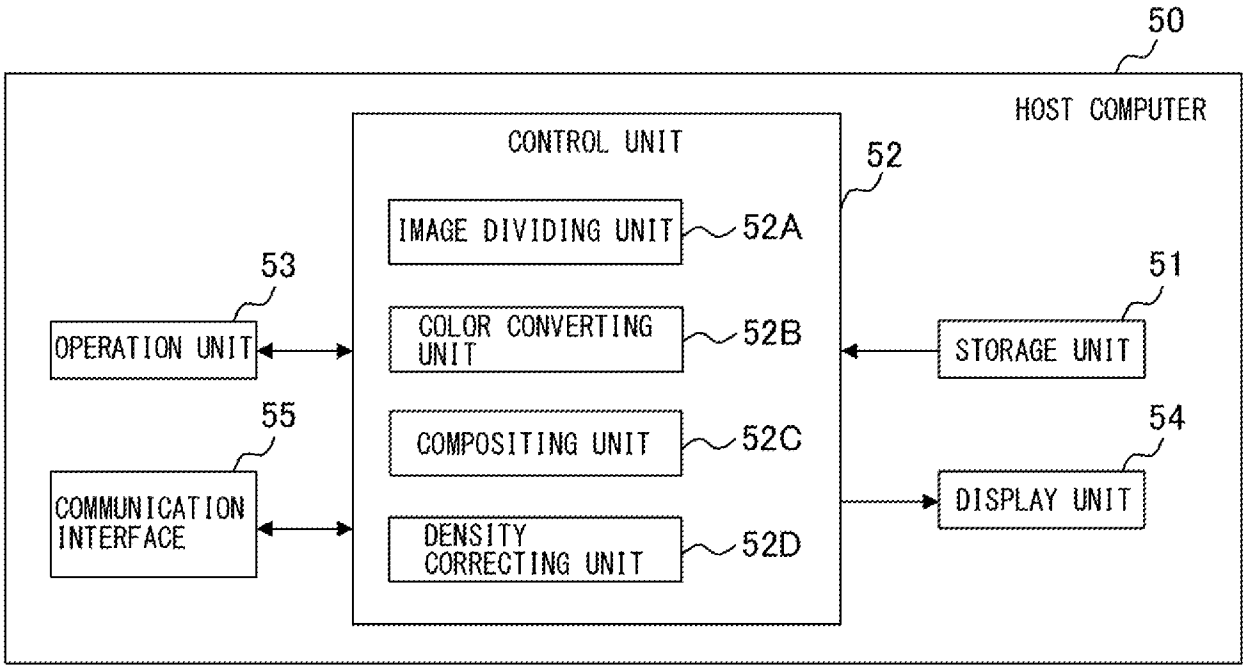
FIG. 2 is a schematic block diagram of a host computer 50.

FIG. 2 is a schematic block diagram of a host computer 50. The host computer 50 is a general-purpose computer which includes a storage unit 51 such as a magnetic disk device, a control unit 52 constructed from a CPU, an operation unit 53 including a keyboard and a mouse, a display unit 54 constructed from a display device, and a communication interface 55. The host computer 50 receives an image print instruction in accordance with a user operation, processes the print image data by using the control unit 52, and transmits the image data and the print instruction to the printer 1 via the communication interface 55.

The host computer 50 performs color management for each dot contained in the overlapping region of the two images to be printed in succession and, from the degree of overlapping between the first image and the second image and the RGB value of the intended color, obtains the grayscale value $RGB_1$ of the first image and the grayscale value $RGB_2$ of the second image. The printer 1 prints each dot in the overlapping region with the energy corresponding to $RGB_1$ when printing the first image and with the energy corresponding to $RGB_2$ when printing the second image, thereby rendering the color corresponding to the intended RGB color.

The following describes how the host computer 50 processes the image data when printing an image having twice the size of each color ink region of the ink ribbon, such as when printing an image of 6×16 inches in size by successively printing two images, each of 6×8 inches, using an ink ribbon for 6×8 size image printing. When printing three or more images in succession and connecting them together, the process is basically the same, i.e., the process hereinafter described need only be repeated for each connection. First, a description will be given below of the table information used for image processing in the host computer 50.

In the printer 1 also, in the overlapping region between the two successive images, one image is overlapped onto the other image by gradually decreasing or increasing the print density in order to make the overlapping region less visible. To achieve this, the storage unit 51 stores a density correction table for the first image and a density correction table for the second image. In particular, since the transfer characteristics differ due to differences in ink colors, the storage unit 51 stores the density correction tables for each of the yellow Y, magenta M, and cyan C colors.

Figure 3:
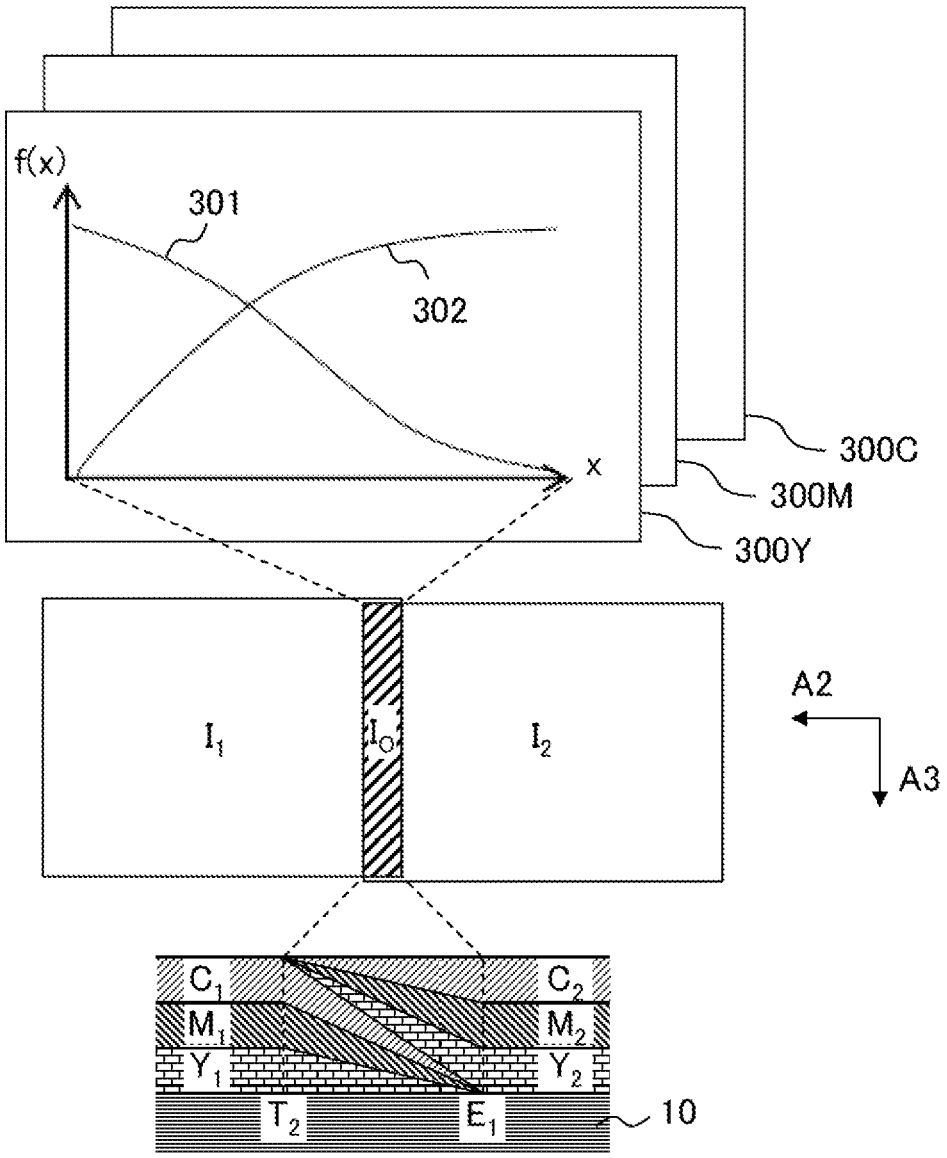
FIG. 3 is a diagram for explaining the density correction tables.

FIG. 3 is a diagram for explaining the density correction tables. In FIG. 3, reference numerals 300Y, 300M, and 300C designate the density correction tables for yellow Y, magenta M, and cyan C, respectively. Arrows A2 and A3 indicate the sub-scanning direction and the main scanning direction, respectively, during transfer operation, and the same designations are used in each diagram hereinafter given. The abscissa x in the density correction table 300Y represents the position along the sub-scanning direction in the overlapping region $I_o$ between the first sub-image $I_1$ and the second sub-image $I_2$, and the ordinate f(x) represents the correction factor for yellow Y in the image data at the position x. A curve indicated by reference numeral 301 is a density correction table for the trailing edge portion of the first sub-image $I_1$, and indicates that the density becomes lower as the position becomes closer to the second image. A curve indicated by reference numeral 302 is a density correction table for the leading edge portion of the second sub-image $I_2$, and indicates that the density becomes higher as the position moves away from the first image. The same applies for magenta M and cyan C.

The lower part of FIG. 3 shows a cross section of the transferred Y, M, and C ink layers in the overlapping region $I_o$. In FIG. 3, $E_1$ indicates the trailing edge of the first sub-image $I_1$, and $T_2$ the leading edge of the second sub-image $I_2$. As shown in FIG. 3, in the printer 1, the connecting edges of the ink layers in the overlapping region $I_o$ coincide for each of the yellow Y, magenta M, and cyan C colors (between $Y_1$, $M_1$, and $C_1$ for the sub-image $I_1$ and between $Y_2$, $M_2$, and $C_2$ for the sub-image $I_2$). Accordingly, the density correction tables 300Y, 300M, and 300C are constructed to cover the same range in the sub-scanning direction. As for the overcoat layer, once the receiving layer on the paper 10 is covered with the overcoat, the color inks cannot be subsequently transferred thereon; therefore, the overcoat layer is transferred so that the connecting edge is located on the first sub-image side of the leading edge $T_2$ of the second sub-image $I_2$.

FIGS. 4(A) and 4(B) are diagrams showing examples of the density correction tables. FIG. 4(A) shows the density correction table for yellow Y for the first sub-image $I_1$, and FIG. 4(B) shows the density correction table for yellow Y for the second sub-image $I_2$. In the illustrated examples, it is assumed that the overlapping region is made up of a number, n, of lines $L_1$ to $L_n$ in the main scanning direction of image transfer (the direction of arrow A3 in FIG. 3), and that the grayscale values of Y are defined in the range of 0 to 255. Each density correction table stores the correction factor for each grayscale value at each position x along the sub-scanning direction (the correction factor for the print density at each position on the overlapping region). The storage unit 51 stores the density correction tables of FIGS. 4(A) and 4(B) for yellow Y, and also stores similarly constructed density correction tables for magenta M and cyan C, respectively.

Each density correction table is constructed through experimentation by printing an equally toned single-color image twice in partially overlapping fashion in accordance with a correction factor with a given initial value, determining whether there is any difference in density between the print overlapping region and the other regions, and if there is a density difference, then adjusting the magnitude of the correction factor, the process being repeated until the density difference is eliminated. For example, the density correction tables for yellow Y, magenta M, and cyan C are constructed using equally toned Y, M, and C images, respectively. Instead of using such Y, M, and C single-colored images, gray tone images differing in gray tone, such as light-toned, medium-toned, and dark-toned images, for example, may be used to construct the density correction tables.

The R, G, and B colors are complementary to the C, M, and Y colors, and when the maximum gray level is represented by 1, the relations C=1-R, M=1-G, and Y=1-B hold. In view of this, the storage unit 51 may store similarly constructed density correction tables for RGB instead of those for YMC.

Further, in the overlapping region, since the yellow Y, magenta M, and cyan C color inks are each transferred twice, the color characteristics may change depending on the mixing ratio of YMC. In view of this, the values in the density correction tables constructed using equally toned images may be further adjusted as needed in order to correct for the change in the color characteristics that can occur due to the color ratio.

Figure 5:
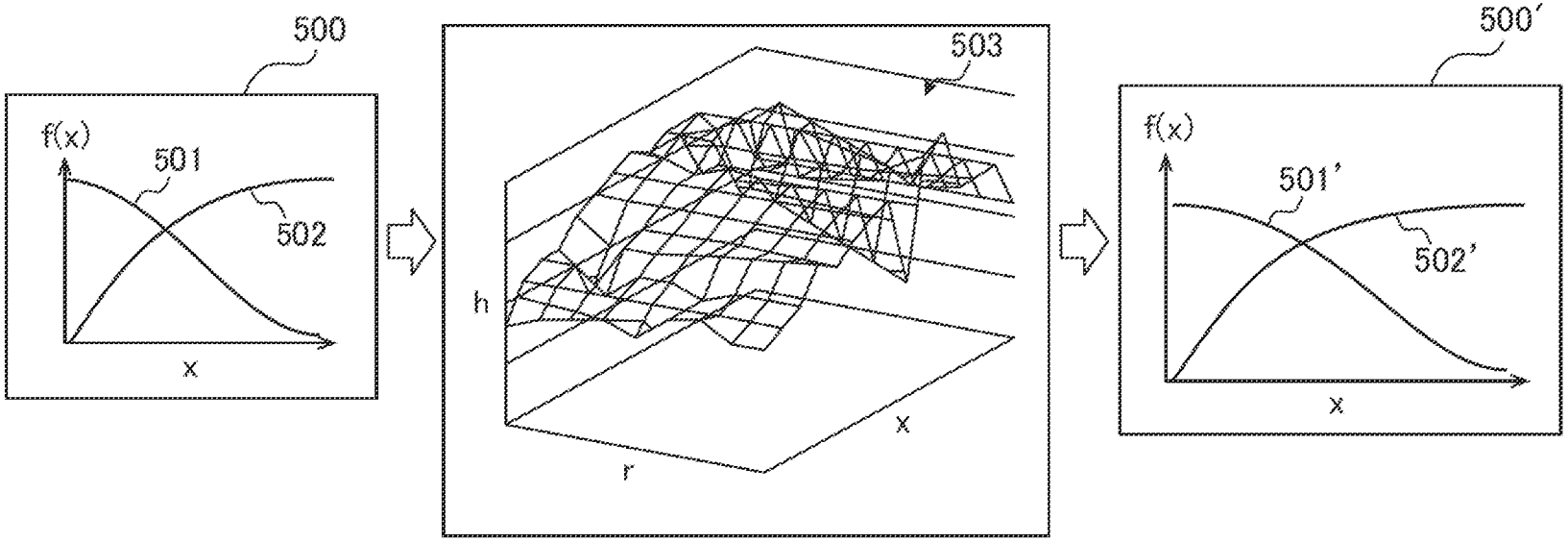
FIG. 5 is a diagram for explaining how the density correction tables are adjusted depending on the color ratio.

FIG. 5 is a diagram for explaining how the density correction tables are adjusted depending on the color ratio. Reference numeral 500 indicates the density correction tables 501 and 502 for the first and second images for yellow Y, magenta M, or cyan C. These tables are the same as those indicated by reference numerals 301 and 302 in FIG. 3. Reference numeral 503 indicates the correspondence relationship between the position x along the sub-scanning direction in the overlapping region, the mixing ratio (color ratio) r of YMC, and the density adjustment value h. Reference numeral 500' indicates the density correction tables 501' and 502' for the first and second images for yellow Y, magenta M, or cyan C, that have been adjusted using the correspondence relationship 503. The density correction tables 501' and 502' are constructed by reflecting the density adjustment value h at each position x along the sub-scanning direction in a given ratio on the respective density correction tables 501 and 502.

Rather than storing the density correction tables 300Y, 300M, and 300C shown in FIG. 3, the storage unit 51 may store the thus adjusted density correction tables 501' and 502' for each of the Y, M, and C colors. Alternatively, the storage unit 51 may store the correspondence relationship 503 and the ratio (duty ratio) indicating how much the density adjustment value h at each position x along the sub-scanning direction is to be reflected. In that case, the control unit 52 may adjust the values in the density correction tables 300Y, 300M, and 300C by referring to these pieces of information as needed.

The storage unit 51 further stores color conversion tables for converting the grayscale values YMC of the Y, M, and C colors into different grayscale values YMC' for a plurality of different positions along the sub-scanning direction in the overlapping region $I_o$. These color conversion tables are used to cancel out any change in color that can occur on the print in the overlapping region at any given position along the sub-scanning direction when two images are transferred, one overlapping the other, in accordance with the above density correction tables. More specifically, each color conversion table stores for each YMC mixing ratio the grayscale value YMC to be transmitted to the printer 1 so that the color corresponding to the intended grayscale value YMC will be printed.

Figure 6:
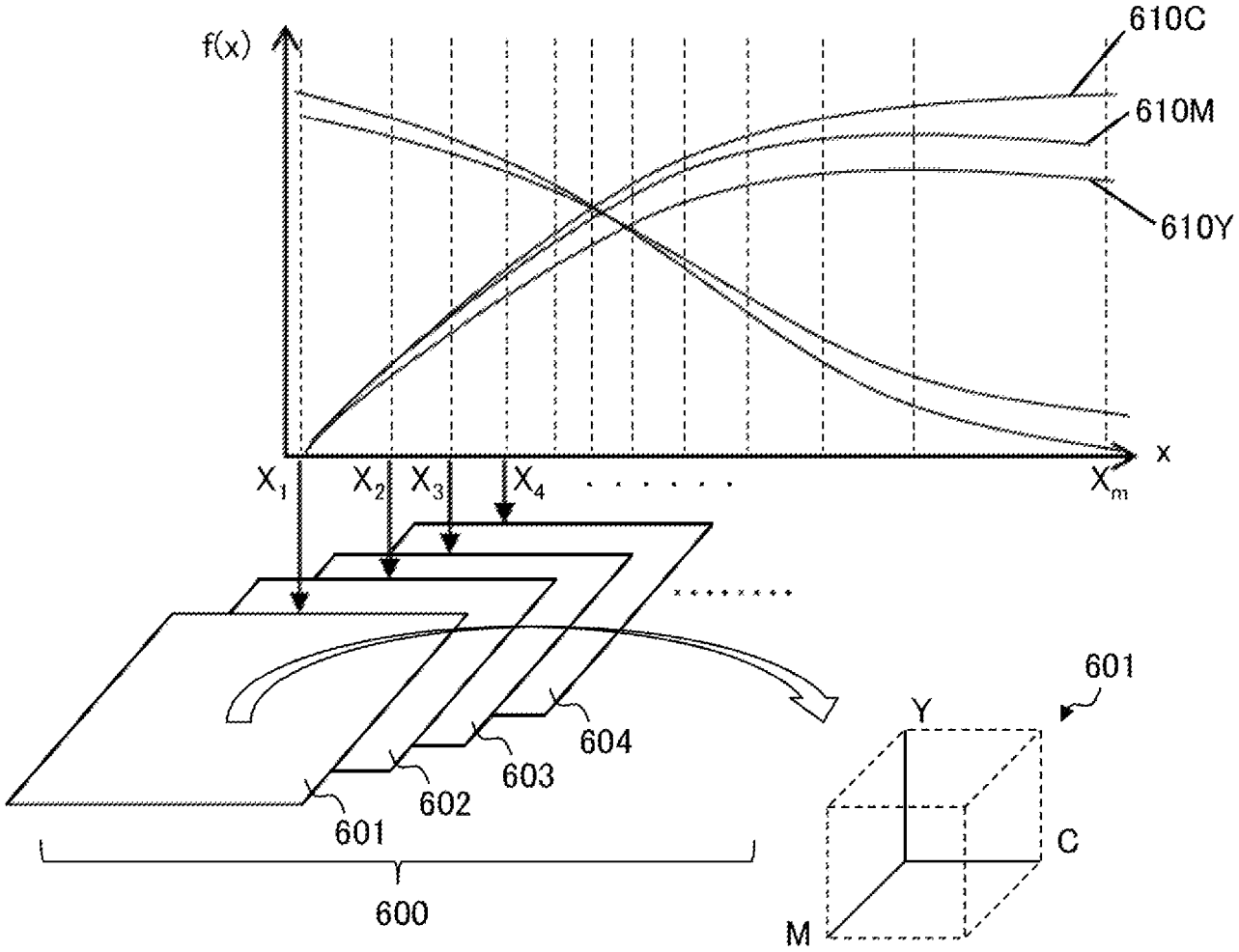
FIG. 6 is a diagram for explaining the color conversion tables.

FIG. 6 is a diagram for explaining the color conversion tables. The abscissa x in the graph shown in the upper part of FIG. 6 represents the position along the sub-scanning direction in the overlapping region $I_o$, and the ordinate f(x) represents the correction factor for the grayscale value of yellow C, magenta M, or cyan C at the position x. Reference numerals 610Y, 610M, and 610C indicate the same density correction tables as those indicated by reference numerals 300Y, 300M, and 300C in FIG. 3 for yellow C, magenta M, or cyan C, respectively.

The storage unit 51 stores the color conversion tables 601, 602, 603, 604, . . . which provide a mapping between the grayscale values YMC before conversion and the grayscale values YMC' after conversion for a plurality of positions $X_1$, $X_2$, $X_3$, . . . , $X_m$ along the sub-scanning direction in the overlapping region $I_o$. These color conversion tables are one example of a color conversion factor group. For example, if the grayscale values of each of the Y, M, and C colors are defined in the range of 0 to 255, then each individual color conversion table is a three-dimensional table having 256×256×256 elements. The color conversion table group 600 constructed from the set of color conversion tables is unique to the printer 1, irrespective of the image to be printed.

In order to reduce the amount of data, the storage unit 51 should store the color conversion tables, not for all the lines $L_1$ to $L_n$ located at different positions along the sub-scanning direction in the overlapping region, but for only some of the lines. For example, in the example of FIG. 6, the color conversion table group 600 is constructed from a number, m (m<n), of color conversion tables corresponding to the positions $X_1$ to $X_m$ along the sub-scanning direction. The positions $X_1$ to $X_m$ for which the respective color conversion tables are constructed need not necessarily be located at equally spaced intervals. For example, the positions $X_1$ to $X_m$ should be selected so that they are located at closely spaced intervals in an area where the correction factors in the density correction tables 610Y, 610M, and 610C change widely and so that they are located at sparse intervals in an area where the correction factors in the density correction tables 610Y, 610M, and 610C change little. As will be described later, the color conversion tables for the other lines than those at the positions $X_1$ to $X_m$ are computed by linear interpolation from the above-constructed color conversion tables.

The color conversion table group 600 is constructed by creating a plurality of color patches with different YMC mixing ratios, printing two color patches for each color by overlapping one onto the other in accordance with the above density correction tables, measuring the printed color at each of the positions $X_1$ to $X_m$ selected along the sub-scanning direction, and obtaining the correspondence relationship between YMC and YMC' for each color. That is, each individual color conversion table corresponds to an ICC profile in color management.

Rather than storing the color conversion tables for YMC, the storage unit 51 may store the correspondence relationship between the RGB values (RGB→RGB') or the correspondence relationship between the RGB and YMC values (RGB→YMC). Alternatively, the storage unit 51 may store the correspondence relationship between the Lab values (Lab→Lab'), which are the color values in the device independent CIE Lab color space, as the color conversion tables.

As shown in FIG. 2, the control unit 52 includes an image dividing unit 52A, a color converting unit 52B, a compositing unit 52C, and a density correcting unit 52D as the functional blocks for processing the image data to be printed. The control unit 52 converts, for example, the RGB values of the image data to be printed into YMC values, and then, using these functional blocks, converts the YMC values in the overlapping region into YMC' values by using the above color conversion tables and converts the YMC' values into the $YMC_1$' values for the first image and the $YMC_2$' values for the second image by using the above density correction tables, and then transmits the converted values to the printer 1. The functions of the functional blocks of the control unit 52 will be described in sequence below.

The image dividing unit 52A divides the color image data to be printed into image data of two sub-images containing an overlapping region. At this time, the image dividing unit 52A does not offset the edge of each sub-image for each of the plurality of color (YMC) inks transferred to the paper, but makes the edges of the two sub-images coincide with each other for each of the Y, M, and C colors, as illustrated in FIG. 3. In other words, since each individual sub-image is formed from the set of Y, M, and C images transferred one on top of another, the image dividing unit 52A divides the color image data to be printed into the image data of the two sub-images so that, in the same sub-image, the edges of the Y, M, and C images coincide with each other as illustrated in the lower part of FIG. 3.

Figure 7:
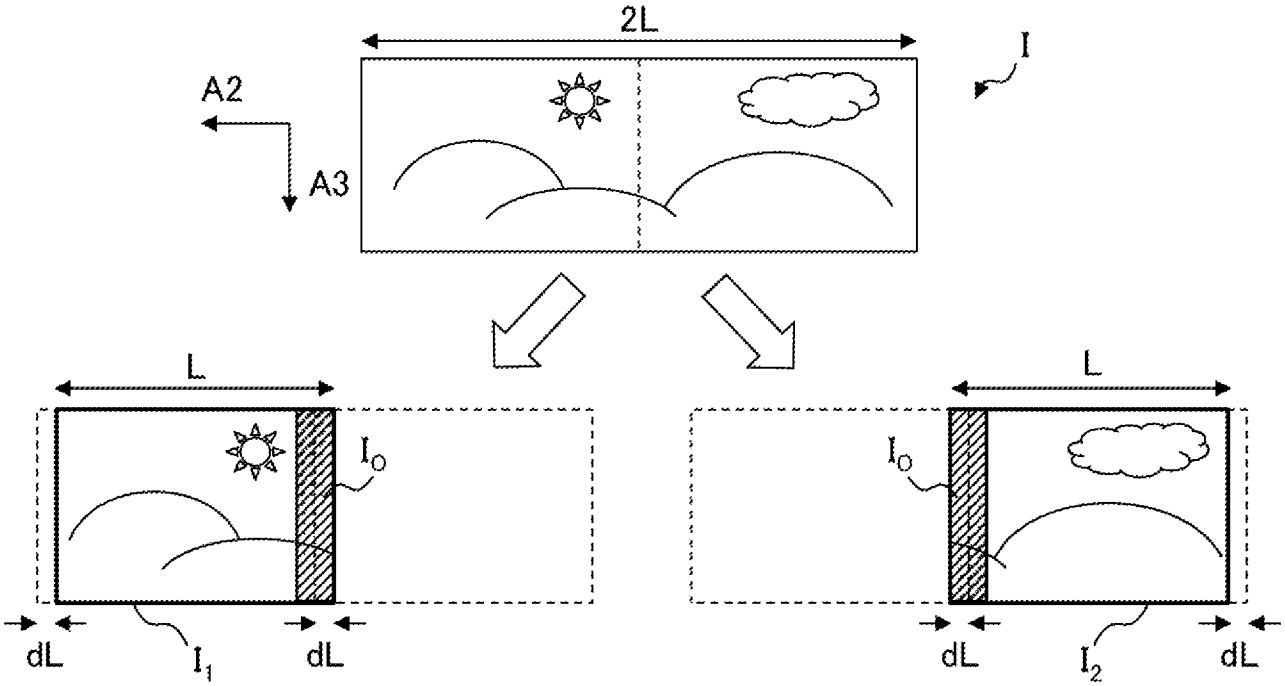
FIG. 7 is a diagram for explaining the function of the image dividing unit 52A.

FIG. 7 is a diagram for explaining the function of the image dividing unit 52A. The width of the 6×16 inch image I to be printed, measured along the sub-scanning direction (the direction of arrow A2), is assumed to be 2L. In order to divide the image I so as to contain the overlapping region, the image dividing unit 52A truncates the leading edge of the image I by cutting off a portion of width dL from it as measured along the sub-scanning direction, and takes the region of width L, as measured along the sub-scanning direction from the truncated leading edge, as the first sub-image $I_1$. Similarly, the image dividing unit 52A truncates the trailing edge of the image I by cutting off a portion of width dL, and takes the region of width L, as measured along the sub-scanning direction from the truncated trailing edge, as the second sub-image $I_2$. Thus, the region of width dL×2 indicated by oblique hatching in the center of the image I forms the common overlapping region $I_o$ of the two sub-images $I_1$ and $I_2$.

The color converting unit 52B, using the color conversion table group stored in the storage unit 51, converts the color values of the print image data in the overlapping region created by the image dividing unit 52A. For example, the color converting unit 52B converts the YMC values of the respective dots forming the overlapping region into the corresponding YMC' values by using the color conversion table group 600. However, when the color conversion table group is constructed using the RGB or Lab values, the color converting unit 52B converts the RGB values or the Lab values. In particular, when the storage unit 51 stores the color conversion tables for all the lines $L_1$ to $L_n$ along the main scanning direction in the overlapping region $I_o$, the color converting unit 52B converts the color values of the respective dots by using the corresponding color conversion table for each line.

However, as previously described with reference to FIG. 6, the storage unit 51 may store the color conversion tables only for some of the lines along the main scanning direction. Then, it is preferable for the color converting unit 52B to divide the overlapping region into a plurality of sub-regions along the main scanning direction of image transfer and to convert the color values of the image data for each of the plurality of sub-regions by using color conversion tables common within that sub-region. In this case, the color converting unit 52B converts the color values of the image data for each sub-region in two ways by using the color conversion table for that sub-region and the color conversion table for its adjacent sub-region.

Figure 8:
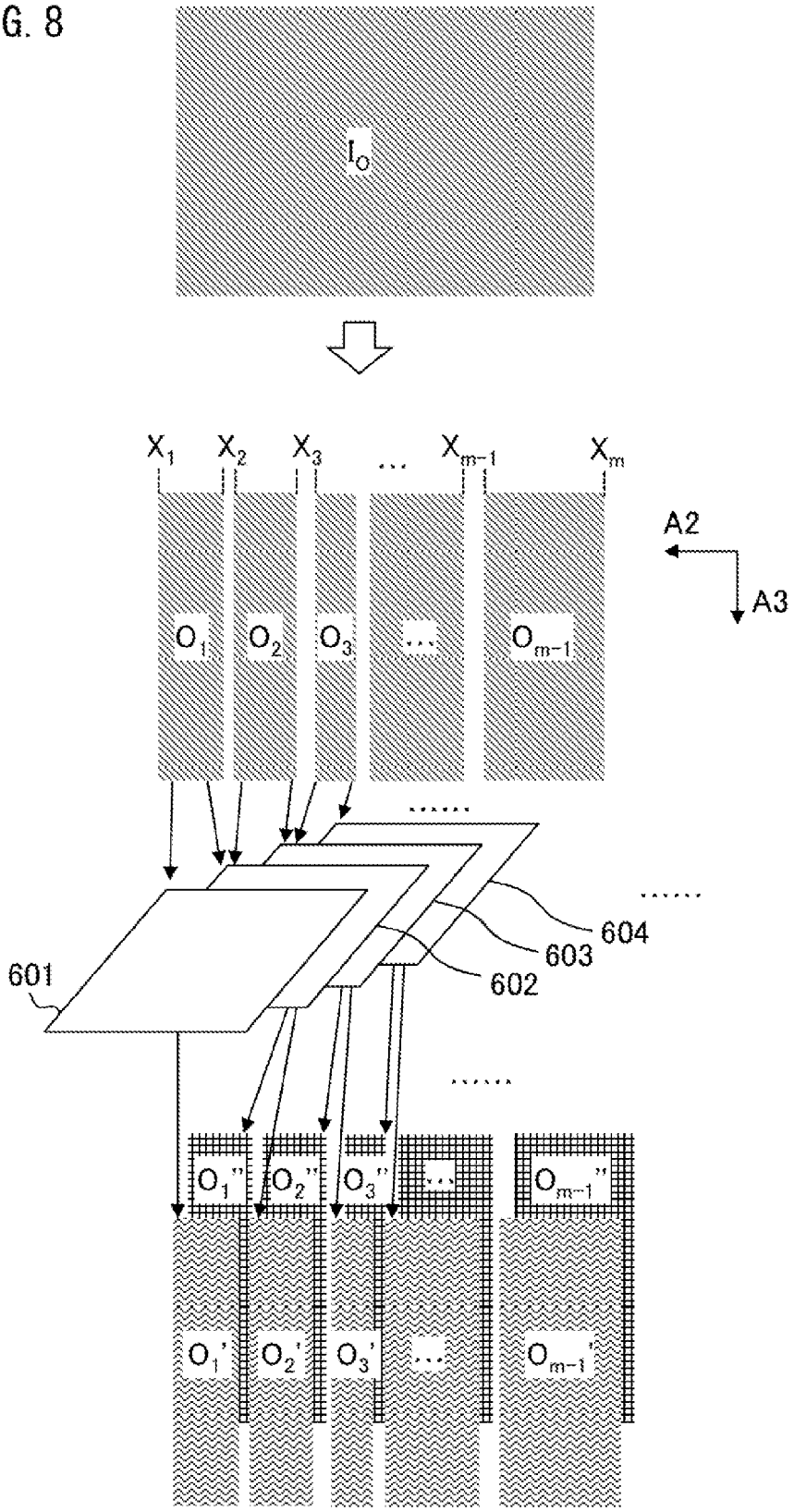
FIG. 8 is a diagram for explaining the function of the color converting unit 52B.

FIG. 8 is a diagram for explaining the function of the color converting unit 52B. First, the color converting unit 52B divides the overlapping region $I_o$ of the two sub-images generated by the image dividing unit 52A into sub-regions $O_1$ to $O_{m-1}$ along the main scanning direction, with their boundaries defined by the positions $X_1$ to $X_m$ along the sub-scanning direction for which the color conversion tables are stored in the storage unit 51. The color converting unit 52B organizes each of the sub-regions $O_1$ to $O_{m-1}$ so that the edges of the Y, M, and C images thereof coincide with each other. For simplicity, it is assumed here that the positions $X_1$ and $X_m$ respectively define the edges of the overlapping region $I_o$.

Then, the color converting unit 52B, using the color conversion tables 601 and 602 for the positions $X_1$ and $X_2$, converts the sub-region $O_1$ into sub-regions $O_1$' and $O_1$", respectively, and using the color conversion tables 602 and 603 for the positions $X_2$ and $X_3$, converts the sub-region $O_2$ into sub-regions $O_2$' and $O_2$", respectively. By repeating this process, the color converting unit 52B creates the image data for the sub-regions $O_1$' to $O_{m-1}$' and the sub-regions $O_1$" to $O_{m-1}$". In this way, the color converting unit 52B creates two sets of image data by converting the image data of each sub-region by first using the color conversion table for that sub-region and then using the color conversion table for its adjacent sub-region.

The compositing unit 52C acquires the converted color values for the entire overlapping region by compositing the color values converted by the color converting unit 52B in two ways for each of the plurality of sub-regions. At this time, the compositing unit 52C composites the individual color values for each sub-region by weighting the color values of the corresponding two sets of image data and adding them together.

Figure 9:
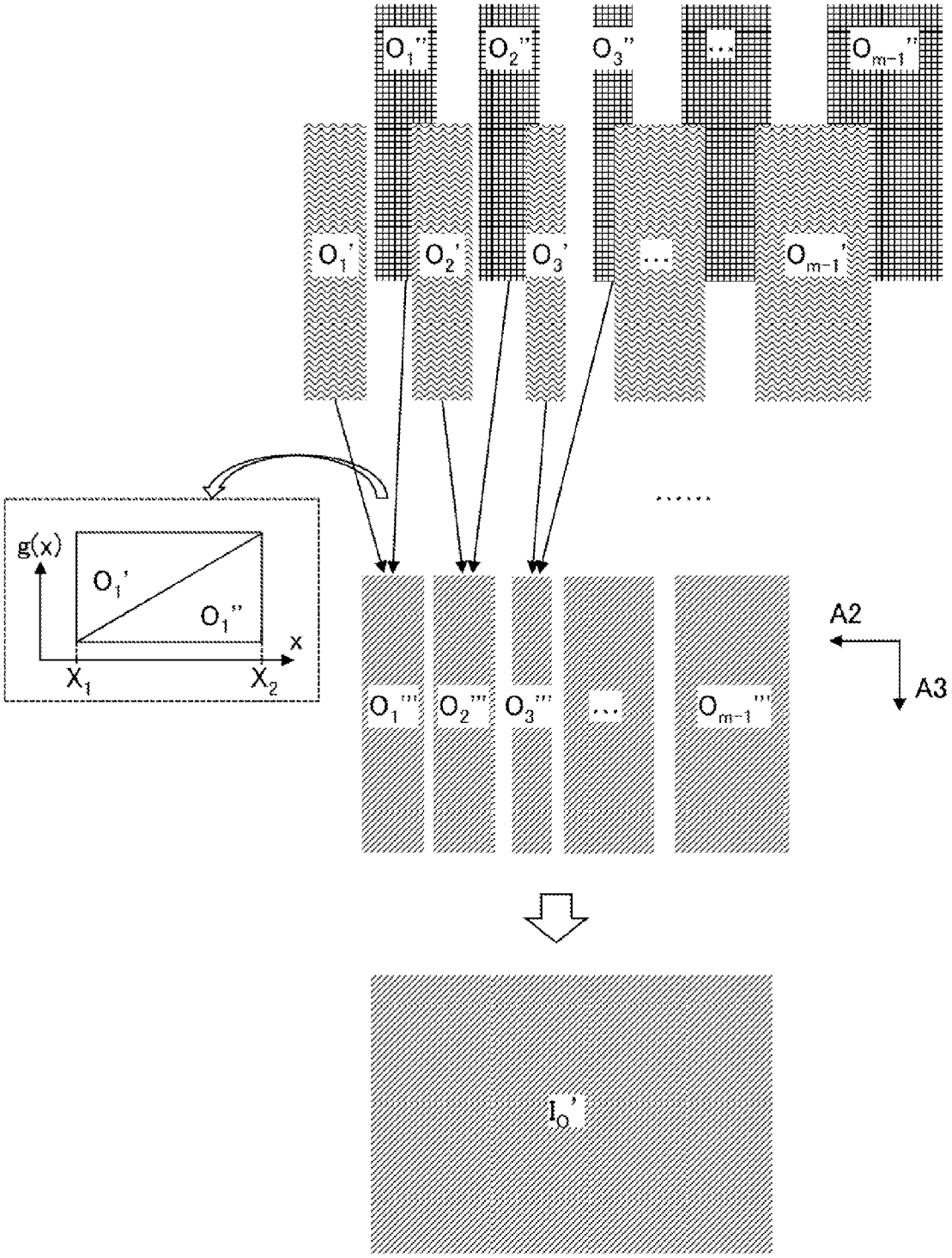
FIG. 9 is a diagram for explaining the function of the compositing unit 52C.

FIG. 9 is a diagram for explaining the function of the compositing unit 52C. The compositing unit 52C composites the sub-regions $O_1'$ and $O_1''$ into a sub-region $O_1'''$, and the sub-regions $O_2'$ and $O_2''$ into a sub-region $O_2'''$. By repeating this process, the compositing unit 52C creates the image data for the sub-regions $O_1'''$ to $O_{m-1}'''$. At this time, for example, for the sub-region $O_1'''$, the compositing unit 52C composites the two color values corresponding to the same dot by weighting the respective color values in such a manner that the proportion of the color value of the sub-region $O_1'$ increases as the dot is closer to the left edge position $X_1$ and the proportion of the color value of the sub-region $O_1''$ increases as the dot is closer to the right edge position $X_2$. In the graph of FIG. 9, the abscissa x represents the position along the sub-scanning direction, and the ordinate g(x) represents the composition ratio between the color values of the sub-regions $O_1'$ and $O_1''$ at the position x. Then, the compositing unit 52C creates the converted image data for the overlapping region $I_o'$ by connecting together the sub-regions $O_1'''$ to $O_{m-1}'''$.

For example, suppose that the sub-region $O_1$ is made up of lines $L_1$ to $L_k$ along the sub-scanning direction; then, in the sub-region $O_1$, the color value on the line $L_1$ at position $X_1$ and the color value on the line $L_k$ at position $X_2$ are converted using the color conversion tables 601 and 602 for the positions $X_1$ and $X_2$, respectively, and the color values on the lines $L_2$ to $L_{k-1}$ are converted using the color conversion tables computed by linear interpolation from the color conversion tables 601 and 602. In this way, even if the color conversion tables for all the lines $L_1$ to $L_n$ along the main scanning direction in the overlapping region $I_o$ are not stored in the storage unit 51, the image data of the overlapping region can be converted so as to cancel out any change in color that can occur on the print in the overlapping region when two images are transferred one overlapping the other. However, when the color conversion tables for all the lines $L_1$ to $L_n$ are stored in advance in the storage unit 51, the compositing unit 52C is rendered unnecessary.

The density correcting unit 52D, using the density correction tables stored in the storage unit 51, adjusts the color values in the overlapping region that have been converted by the color converting unit 52B and composited by the compositing unit 52C. That is, using the density correction table for the first image and the density correction table for the second image, the density correcting unit 52D corrects the YMC grayscale values of the overlapping region after the conversion and composition, and thereby creates the image data for the overlapping region of the first image and the overlapping region of the second image. Then, by reflecting the overlapping regions into each sub-region, the density correcting unit 52D creates the image data of the first image and the image data of the second image.

Figure 10:
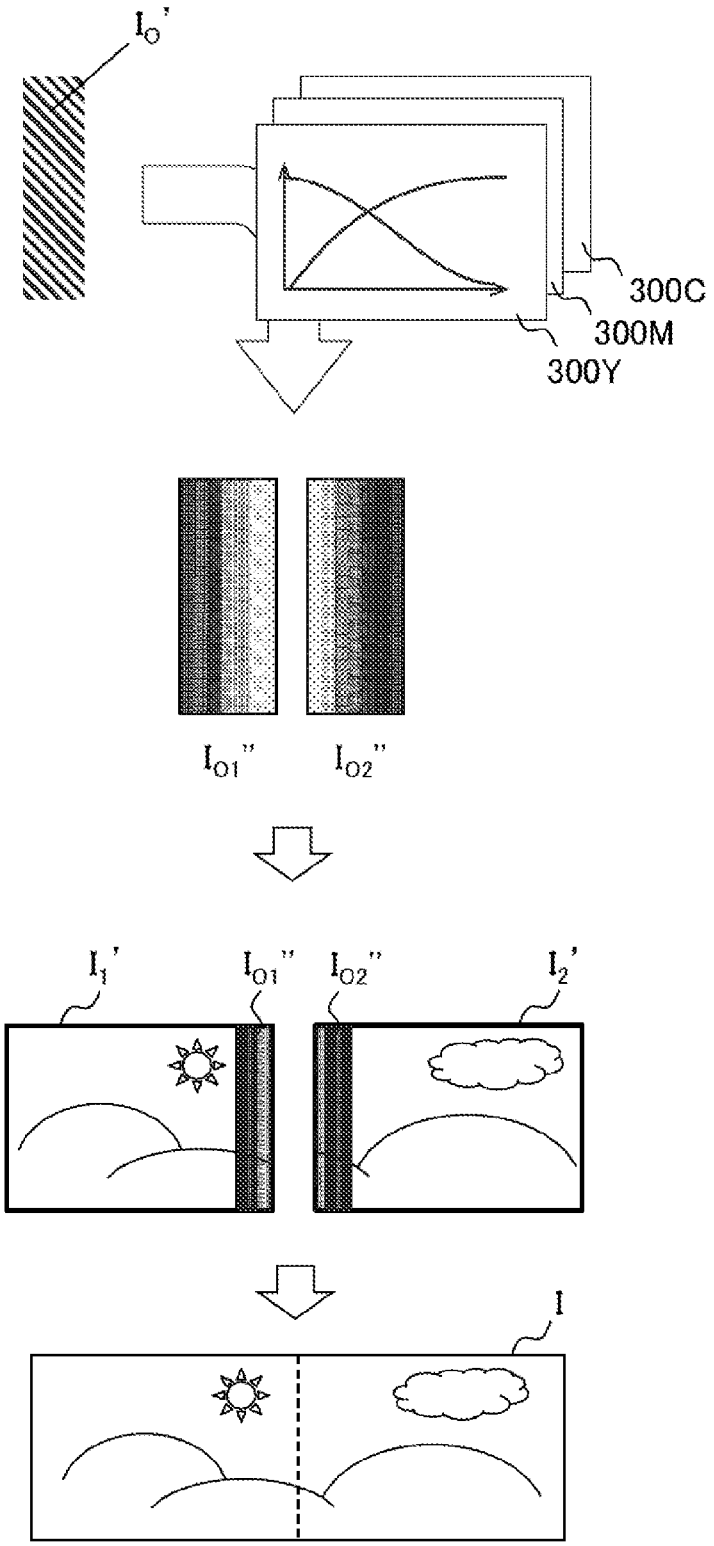
FIG. 10 is a diagram for explaining the function of the density correcting unit 52D.

FIG. 10 is a diagram for explaining the function of the density correcting unit 52D. First, using the density correction tables 300Y, 300M, and 300C, the density correcting unit 52D corrects the YMC values of the image data in the overlapping region $I_o'$ that have been composited by the compositing unit 52C. For example, for yellow Y, the density correcting unit 52D creates the Y value of the image data in the overlapping region $I_{o1}''$ of the first sub-image by applying the table of FIG. 4(A) (the curve 301 in FIG. 3), and creates the Y value of the image data in the overlapping region $I_{o2}''$ of the second sub-image by applying the table of FIG. 4(B) (the curve 302 in FIG. 3). For magenta M and cyan C also, the density correcting unit 52D creates the grayscale values in the overlapping regions for the two sub-images in a like manner. The thus created YMC values represent the image data in the overlapping region $I_{o1}''$ of the first sub-image and the image data in the overlapping region $I_{o2}''$ of the second sub-image.

Then, the density correcting unit 52D creates the image data of the final two sub-images $I_1'$ and $I_2'$ by correcting the overlapping region $I_o$ of the first sub-image $I_1$ by the overlapping region $I_{o1}''$ and by correcting the overlapping region $I_o$ of the second sub-image $I_2$ by the overlapping region $I_{o2}''$.

The control unit 52 transmits the image data of the two sub-images $I_1'$ and $I_2'$ created by the density correcting unit 52D to the printer 1 via the communication interface 55. Then, in accordance with the image data of the two sub-images $I_1'$ and $I_2'$, the printer 1 sequentially transfers the sub-images so that the two sub-images overlap at the overlapping region, and thereby forms a color image I to be printed on the paper. In this way, the printer 1 achieves panoramic printing.

When the printer 1 prints an image not larger than the size of each ink region of the ink ribbon (i.e., when the printer 1 does not perform panoramic printing), the host computer 50 does not perform the above image processing, and transmits the RGB values (YMC values) of the print image data directly to the printer 1.

Figure 11:
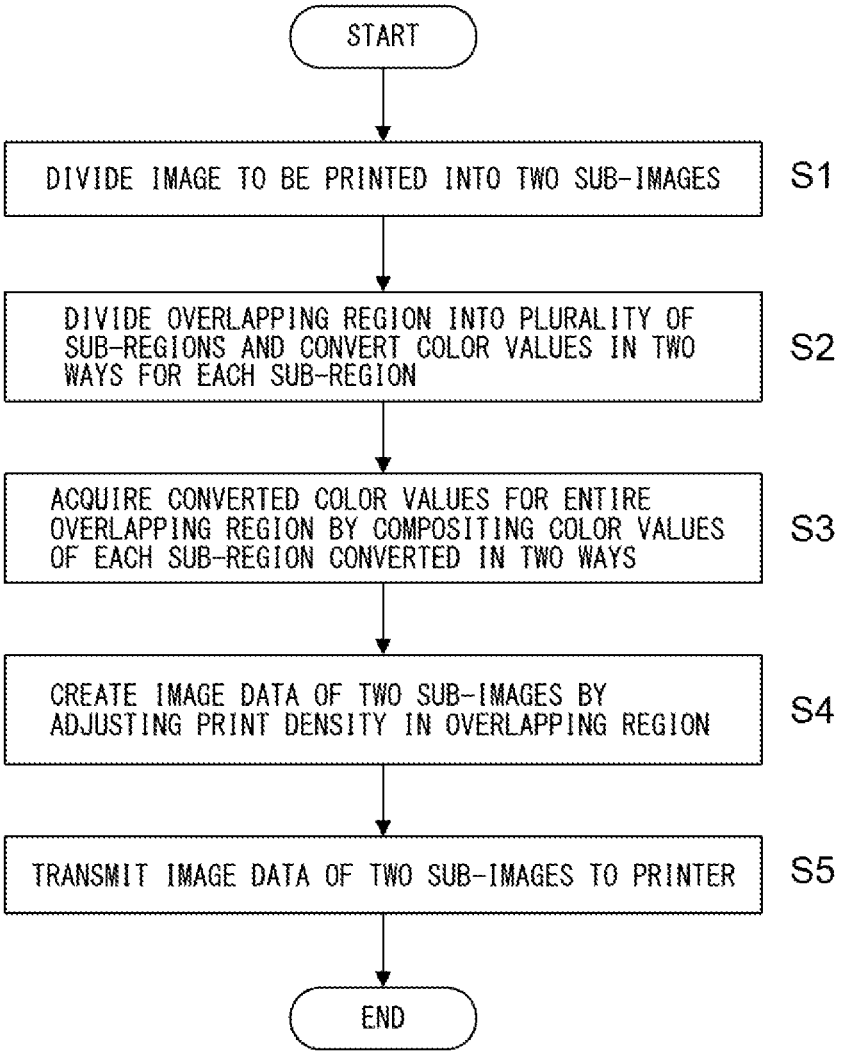
FIG. 11 is an image data processing flow performed by the control unit 52.
Figure 12:
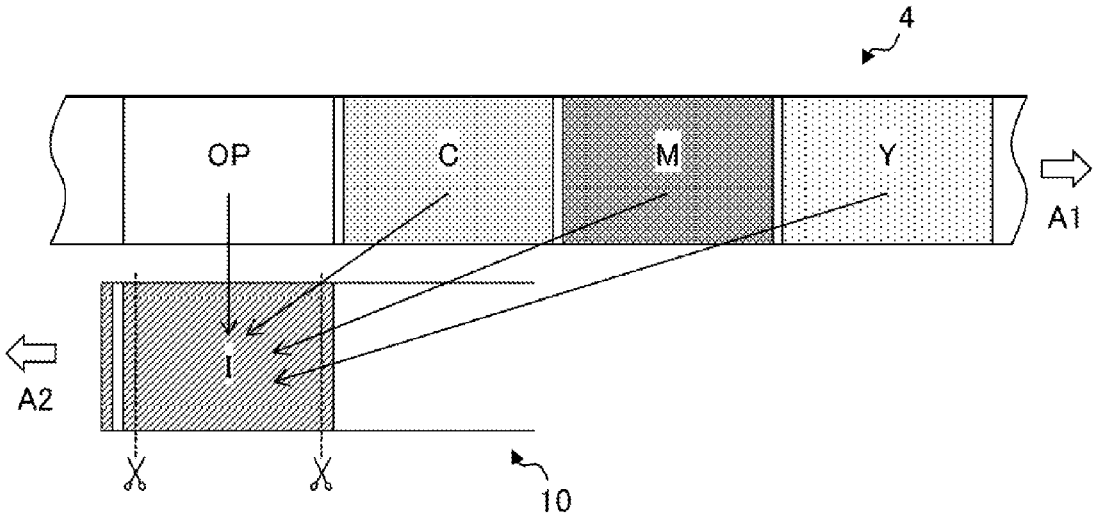
FIG. 12 is a diagram for explaining a normal printing operation performed by a thermal transfer printer.
Figure 13:
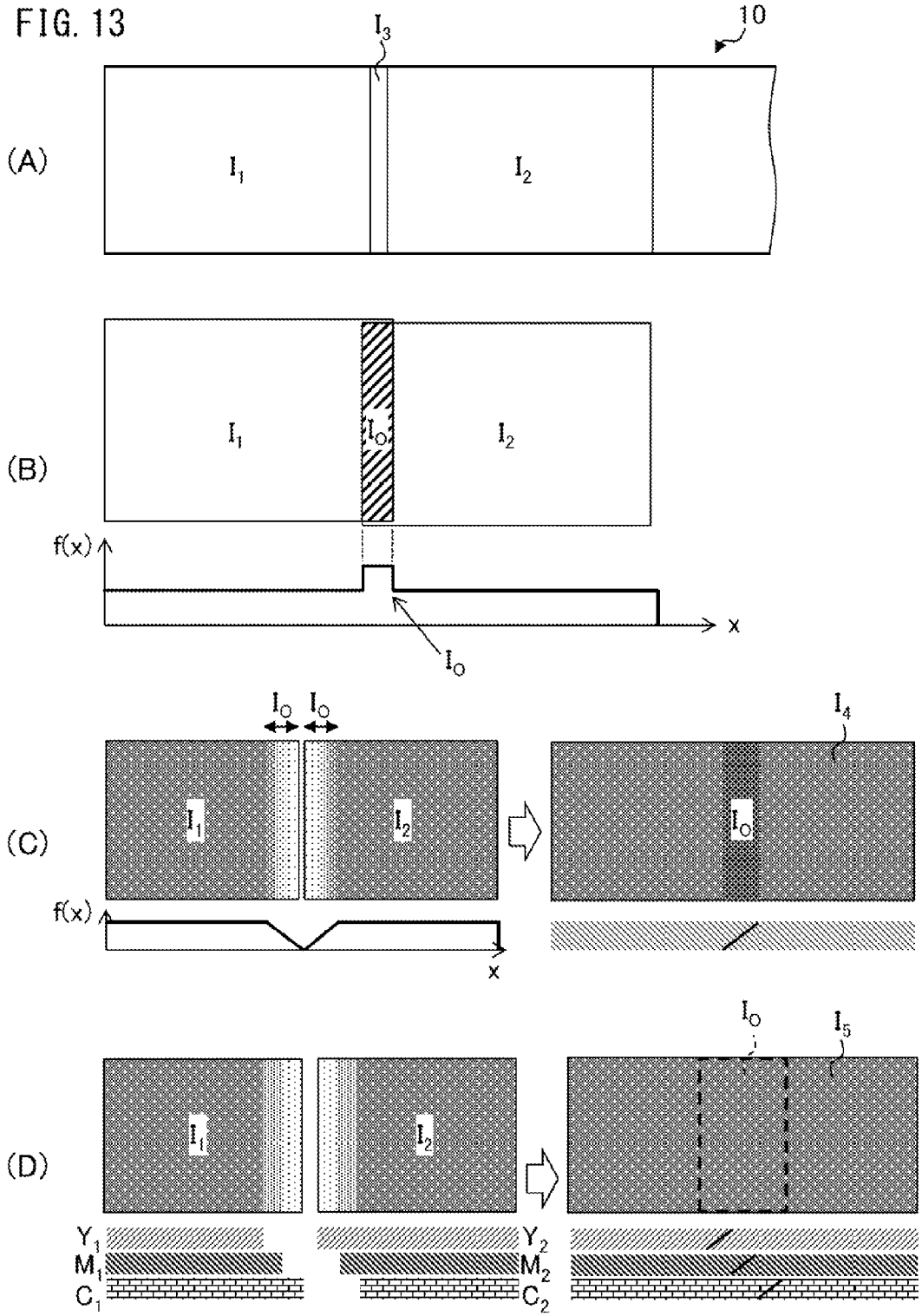
FIG. 13 is a diagram for explaining a prior art panoramic printing method.

FIG. 11 is an image data processing flow performed by the control unit 52. The illustrated flow is executed by the CPU included in the control unit 52 in accordance with a program stored in advance in a ROM included in the control unit 52 of the host computer 50. It is assumed here that the printer 1 in which the ink ribbon having color ink regions each measuring 6×8 inches in size is instructed to print an image measuring 6×16 inches in size.

First, the image dividing unit 52A divides the color image data to be printed into image data of two sub-images containing an overlapping region (S1). Next, the color converting unit 52B divides the overlapping region created in S1 into a plurality of sub-regions whose boundaries are defined by the positions $X_1$ to $X_m$ along the sub-scanning direction for which the color conversion tables are stored in the storage unit 51, and converts the color values in each sub-region in two ways by using the color conversion tables (S2). More specifically, the color converting unit 52B converts the color values of the image data for each sub-region in two ways by using the color conversion table for that sub-region and the color conversion table for its adjacent sub-region.

Then, the compositing unit 52C acquires the converted color values for the entire overlapping region by compositing the color values of each sub-region converted in two ways in S2 (S3). Then, using the density correction tables stored in the storage unit 51, the density correcting unit 52D adjusts the converted print density in the overlapping region acquired in S3, and thus creates image data of the two sub-images (S4). Finally, the control unit 52 transmits the image data of the two sub-images created in S4 to the printer 1 (S5). This completes the image data processing flow of the control unit 52.

As has been described above, in the printer 1, the color conversion tables are constructed in advance which are used to convert the color values of the image data so as to cancel out any change in color that can occur in the image overlapping region when two images are transferred successively. The host computer 50 corrects the color values of the print image data by using the color conversion tables, in order to suppress the occurrence of color changes in the image overlapping region. Further, in the printer 1, the connecting edges of the ink layers of the successively transferred two images are made to coincide for each of the Y, M, and C colors. This serves to minimize the size of the image overlapping region, making it possible to efficiently utilize each color ink region of the ink ribbon.

The image processing performed by the image dividing unit 52A, color converting unit 52B, compositing unit 52C, and density correcting unit 52D in the host computer 50 may be performed by the control unit 20 in the printer 1. In that case, the density correction tables 300Y, 300M, and 300C and the color conversion table group 600 necessary for the image processing are stored in advance in an internal memory implemented in the printer 1.

What is claimed is:

1. A method for controlling a thermal transfer printer, comprising the steps of:

dividing color image data to be printed into image data of two sub-images containing an overlapping region and having edges that coincide for each of a plurality of color inks transferred to paper;

converting color values of the color image data in the overlapping region by using a color conversion factor group created in advance for a plurality of different positions on the overlapping region so as to cancel out a color change that occurs in the overlapping region when the two sub-images are transferred with one overlapping the other;

correcting the image data of the two sub-images by adjusting converted color values in the overlapping region by using a correction factor for print density at each position on the overlapping region; and forming a color image to be printed by sequentially transferring the two sub-images in accordance with corrected image data of the two sub-images so that the two sub-images overlap at the overlapping region.

2. The method according to claim 1, wherein in the converting step, the overlapping region is divided into a plurality of sub-regions along a main scanning direction of image transfer, and the color values of the color image data are converted for each of the plurality of sub-regions by using a color conversion factor group common within the sub-region.

3. The method according to claim 2, wherein in the converting step, the color values of the color image data are converted in two ways for each of the plurality of sub-regions by using a color conversion factor group created for the sub-region and a color conversion factor group created for a sub-region adjacent thereto, and wherein the method further comprises the step of:

acquiring the converted color values for the entire overlapping region by compositing the color values converted in two ways for each of the plurality of sub-regions.

4. A thermal transfer printer comprising:

an image dividing unit which divides color image data to be printed into image data of two sub-images containing an overlapping region and having edges that coincide for each of a plurality of color inks transferred to paper;

a color converting unit which converts color values of the color image data in the overlapping region by using a color conversion factor group created in advance for a plurality of different positions on the overlapping region so as to cancel out a color change that occurs in the overlapping region when the two sub-images are transferred with one overlapping the other;

a density correcting unit which corrects the image data of the two sub-images by adjusting converted color values in the overlapping region by using a correction factor for print density at each position on the overlapping region; and an image printing unit which forms a color image to be printed by sequentially transferring the two sub-images in accordance with corrected image data of the two sub-images so that the two sub-images overlap at the overlapping region.

* * * * *